United States Patent [19]

Landa

[11] 4,269,504

[45] May 26, 1981

[54] PICKOFF DEVICE FOR COPYING MACHINE

[75] Inventor: Benzion Landa, Edmonton, Canada

[73] Assignee: Savin Corporation, Valhalla, N.Y.

[21] Appl. No.: 60,357

[22] Filed: Jul. 25, 1979

Related U.S. Application Data

[63] Continuation of Ser. No. 850,216, Nov. 9, 1977, abandoned.

[51] Int. Cl.[3] ..... G03G 15/00

[52] U.S. Cl. ..... 355/3 SH; 271/DIG. 2; 271/308

[58] Field of Search ..... 355/3 R, 3 SH, 3 TR, 355/133; 271/DIG. 2, 275, 277, 308, 311

[56] References Cited

U.S. PATENT DOCUMENTS

| | | | |
|---|---|---|---|
| 3,046,009 | 7/1962 | Hartel | 271/176 |
| 3,684,363 | 8/1972 | Ito et al. | 355/3 R |
| 3,791,729 | 2/1974 | Steiner | 355/3 R |
| 4,062,631 | 12/1977 | Ichikawa et al. | 355/3 R |
| 4,073,585 | 2/1978 | Kobayashi et al. | 271/DIG. 2 X |

OTHER PUBLICATIONS

Beaudrot, C. B., "Backup Pick-Off Control"; IBM Technical Disclosure Bulletin; vol. 15, No. 7, Dec. 1972, p. 2195.

*Primary Examiner*—Fred L. Braun
*Attorney, Agent, or Firm*—Shenier & O'Connor

[57] ABSTRACT

A pickoff device for a copying machine of the image transfer type in which the leading edge of the copy sheet to which the image has been transferred is guided from the surface on which the image was formed and developed into the narrow space between a first continually driven clutch element and a second clutch element resiliently restrained against frictional rotation with the first clutch element in the absence of a copy sheet in the space between the elements with this space being sufficiently narrow that entry of the leading edge of the copy sheet into the space clutches the elements together to move as a unit to carry the copy sheet around to a location at which the clutch automatically releases as the leading edge of the copy sheet enters the nip between an upper metallic delivery roller and a lower delivery roller which moves with the first clutch member. Any suitable device, such as a mechanical finger, a jet of air or the like may be employed to direct the leading edge of the sheet into the clutch. The apparatus incorporates one or more elements for directing second sheets of misfed double feeds back to the delivery rollers thus to prevent the second sheet from wrapping around the cleaning roll of the machine.

23 Claims, 9 Drawing Figures

Fig 1
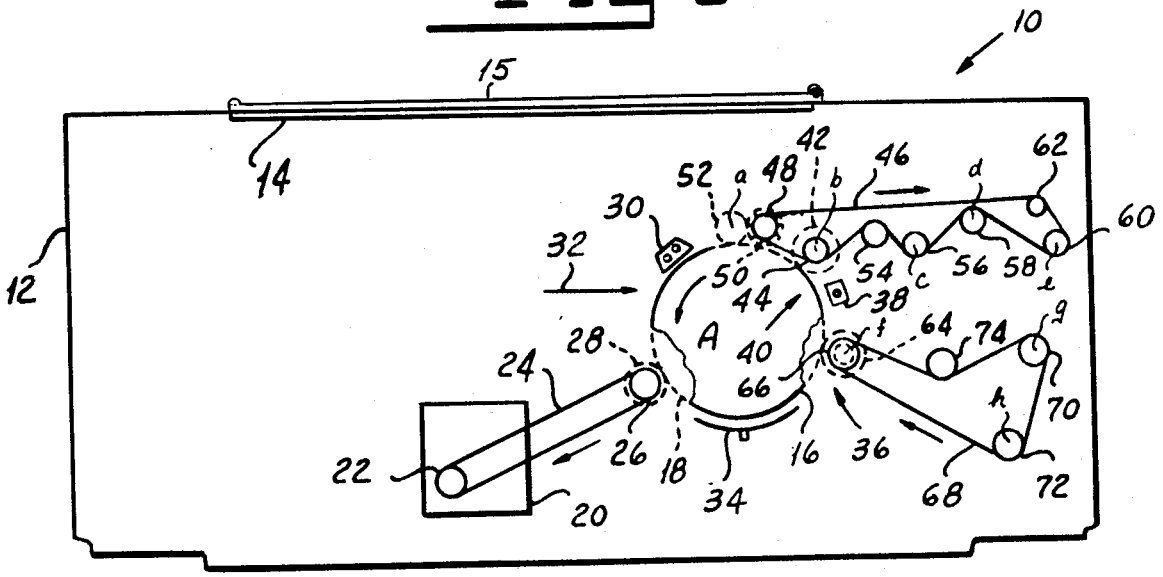
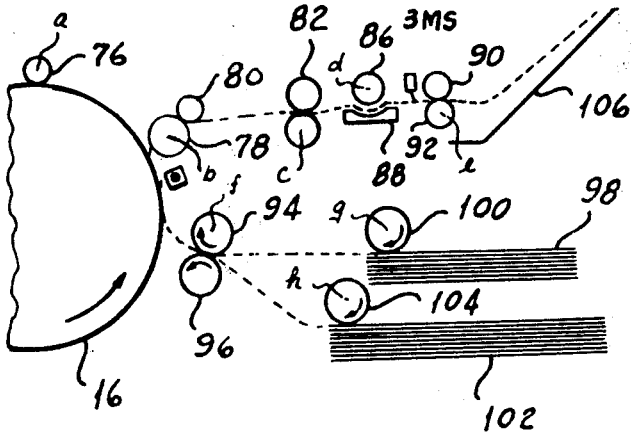
Fig 2

PICKOFF DEVICE FOR COPYING MACHINE

This is a continuation of application Ser. No. 850,216, filed Nov. 9, 1977, now abandoned.

BACKGROUND OF THE INVENTION

These are known in the prior art plain paper electrostatic copying machines in which a drum carries a surface coating of photoconductive material, such for example as selenium. In operation of such a machine the surface of the drum is moved successively past the charging station at which a corona applies a uniform electrostatic charge over the surface of the drum and then to an exposure station at which the charged surface is exposed to an image of the original to be copied. At this station, the surface of the drum over relatively light areas of the image to be copied loses its charge while retaining its charge in relatively darker areas of the original, thus to produce a latent electrostatic image of the original to be copied.

Following the exposure station, the surface is carried through a developer station at which the latent image is subjected to the action of the developer including toner particles which adhere to the charged areas of the image, thus to develop the image. As the surface carrying the developed image leaves the developer station, it moves past a point at which a length of copy material, such as ordinary paper to which the image is to be transferred is fed to the drum so as to be carried along with the drum beneath a transfer corona. This transfer corona causes the particles of toner to migrate from the surface of the photoconductor to the surface of the copy sheet.

After the image has thus been transferred to the length of copy material, it is necessary to remove the sheet from the surface of the photoconductor which may, for example, be on a drum. In one particular arrangement employed to pickoff a copy sheet carrying a developed image in a machine of the type described above, a stationary flexible band conforming to the configuration of the drum over a portion of the circumference thereof from the location at which copy material is fed to the drum to a location beyond the transfer corona is mounted at the edge of the drum, so that a narrow strip of copy material extending along a side thereof moves over the stationary flexible band as the length of copy material moves under the transfer corona. At the point at which the copy material is to be removed from the surface of the drum, a struck up portion of the flexible strip moves a leading corner of the length of copy material away from the drum and into the nip between a turn roll and a rubber belt, a portion of the length of which extends around and into contact with the surface of the turn roll. The turn roll is driven in cooperation with the belt to carry the developed sheet away from the photoconductive drum toward conveyor rollers which deliver the sheet to the user of the machine. This pickoff arrangement is illustrated in and is more fully described in Ariyama U.S. Pat. No. 3,936,045, for "Sheet Stripping Device for Copying Apparatus".

After the photoconductive surface leaves the pickoff station described hereinabove, it next moves through a cleaning station at which a sponge roller in engagement with the surface of the drum is driven in such a direction that the engaging surface portions of the roller and the drum move in opposite directions. This sponge roller normally is wet with developer to facilitate the cleaning action and to prevent scratching of the drum surface by toner particles which remain on the roller when the developer dries.

While the machine described above functions satisfactorily in most instances, it incorporates a number of serious disadvantages. First, it will readily be apparent from the description of the pickoff system described hereinabove, that the copy sheet can have no image transferred thereto over the space along the edge thereof which rides over the flexible band extending through the transfer station. Thus, where the original carries information or printing in this area, it will not appear on the copy. Attempts to obviate this problem by minor modifications for directing the corner of the sheet into the nip between the turn roller and the belt without the use of a strip extending through the transfer station have not proved successful since any developed image in the strip which formerly was blank become smeared or dirtied. Another defect of the machine described hereinabove arises in connection with accidental double feeding of copy sheets from the supply to the drum. The first of the two sheets will be picked off by the pickoff device but often times the second sheet misses the pickoff. When this occurs the sheet may continue to travel around with the drum and become wrapped around the cleaning roller and ultimately soaked with developer, so as to assume a dark appearance so as not to be readily discernible. In such an instance upon continued use of the machine, the sheet wrapped around the cleaning roller scratches the surface of the photoconductor and ultimately may require replacement of the photoconductive drum. This member is one of the more expensive components of the machine.

SUMMARY OF THE INVENTION

One object of my invention is to provide a pickoff for a copying machine which overcomes the defects of pickoff systems of the prior art.

Another object of my invention is to provide a pickoff device for a copying machine which permits the substantially entire area of the copy sheet to receive a transferred image.

Still another object of my invention is to provide a pickoff device for a copying machine which is reliable in operation.

A still further object of my invention is to provide a pickoff device for a copying machine which prevents a double fed sheet from wrapping around the cleaning roller of the machine.

A still further object of my invention is to provide a pickoff device for a copying machine which returns a double fed sheet to the user along the same path as a copy sheet to which an image has been transferred.

Other and further objects of my invention will appear in the following description.

BRIEF DESCRIPTION OF THE DRAWINGS

In the accompanying drawings which form part of the instant specification and which are to be read in conjunction therewith and in which like reference numerals are used to indicate like parts of the various views:

FIG. 1 is a simplified schematic view of the drive system of an electrostatic copying machine incorporating my pickoff device with parts of the machine removed.

FIG. 2 is a diagrammatic view of the copy paper handling system of the electrostatic copier illustrated in FIG. 1.

DESCRIPTION OF THE PREFERRED EMBODIMENT

Figures 3, 4:
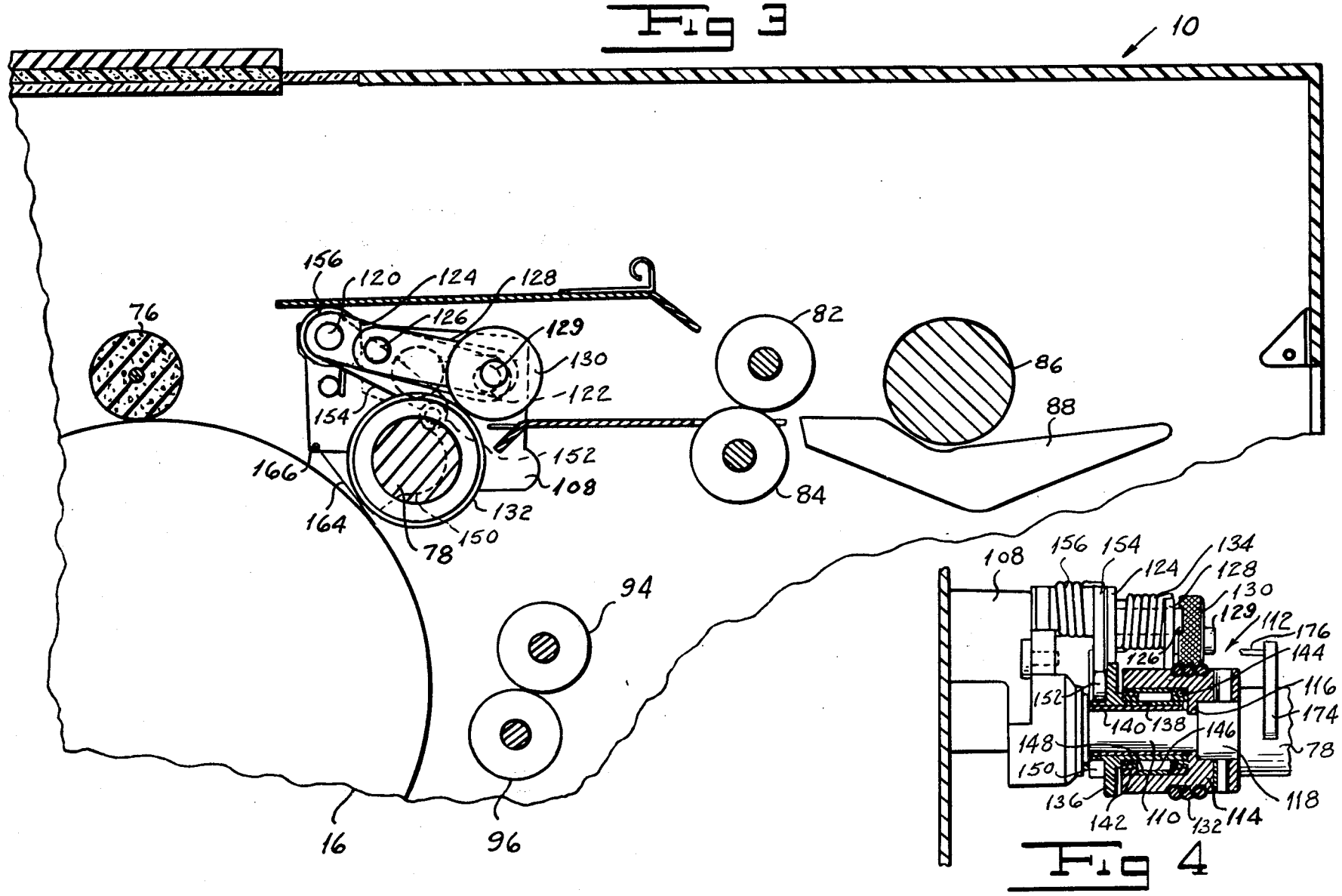
FIG. 3 is a fragmentary sectional view of the copying machine illustrated in FIGS. 1 and 2 and showing the details of my pickoff device.
FIG. 4 is a fragmentary view with parts in section illustrating my pickoff device for copying machines.
Figure 5:
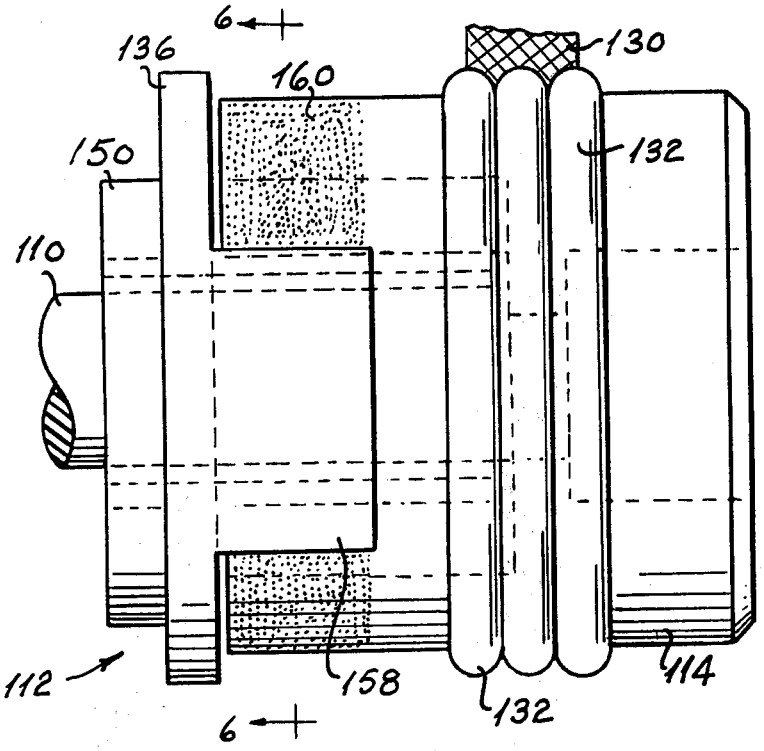
FIG. 5 is a fragmentary elevation of a portion of my pickoff device for copying machines.
Figure 6:
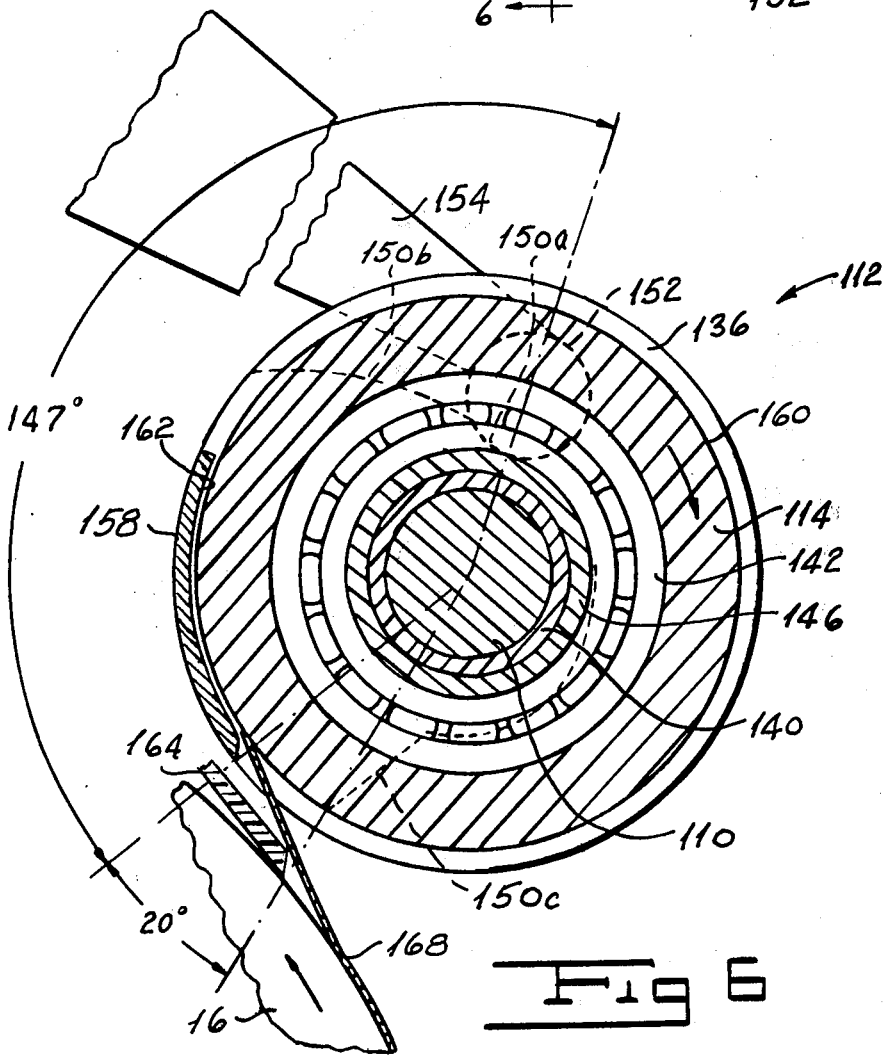
FIG. 6 is a fragmentary sectional view of one form of my pickoff device for copying machines.

Referring now to FIG. 1 and 2 of the drawings, a machine indicated generally by the reference character 10 with which my pickoff device is used includes a cabinet 12, the top of which is provided with a transparent platen 14, normally covered by a cover 15 hinged to the cabinet. The cover can be moved away from the platen to permit an original to be placed face down to the platen. A drum 16 carrying a suitable photoconductor on the surface thereof is rotatably supported for movement in the cabinet 10 by any suitable means known to the art. In the schematic view in FIG. 1, for purposes of simplicity, I have illustrated gears in broken lines and have indicated sprocket wheels in full lines. A gear 18 which rotates with the drum 16 is adapted to be driven to rotate the drum in the direction of the arrow A in FIG. 1. Machine 10 includes a prime mover 20, the output shaft of which carries a sprocket wheel 22 adapted to drive a pitch chain 24 to drive a sprocket wheel 26. Chain 24 moves in the direction of the arrow adjacent to the chain so that a gear 28 mounted on the shaft of sprocket wheel 26 for rotation therewith drives gear 18 to rotate the drum 16 in the direction of the arrow A.

Further, as is known in the art, as the drum 16 rotates in the direction of the arrow A, its surface moves successively past a corona 30, which is activated to produce a uniform electrostatic charge on the surface of the drum. After leaving the corona 30, the surface passes by an exposure station indicated by the arrow 32 at which a moving optical system scans the original which has been placed face down on platen 14 so as to translate a line image of the original to the surface of the moving drum 16. Since the details of the optical system, per se, form no part of my invention, they have not been shown in the drawings.

After leaving the exposure station 32, the surface of the drum moves through a developer unit 34 at which the latent electrostatic image thereon is subjected to the action of a liquid developer containing particles of toner which adhere to those areas of the drum surface which have retained their charge after exposure to the image. As the developed image moves further in the direction of the arrow A, a sheet of plain paper is fed to the drum at a station indicated generally by the reference character 36. The paper moves with the drum past a transfer corona 38 which is energized to cause the developed image to migrate from the surface of the drum to the underside of the paper. After transfer has thus been effected, the sheet carrying the developed and transferred image is to be carried away from the drum at a pickoff station indicated generally by the reference character 40.

A gear 42 which meshes with the drum gear 18 provides the input to the copy pickoff and delivery system. Gear 42 is on a shaft which is common with a sprocket wheel 44 so that gear 42 and sprocket wheel 44 rotate around an axis "b" which is the axis of the take-off roll to be described more fully hereinbelow. Sprocket wheel 44 drives pitch chain 46 in the direction of the arrow adjacent to the chain in FIG. 1. Chain 46 in turn drives a sprocket wheel 48, the shaft of which also carries a gear 50 which meshes with a gear 52 to drive gear 52 in a counterclockwise direction around the axis "a" of the cleaner roll to be described in detail hereinbelow.

Chain 46 also engages a tensioning sprocket wheel 54 and a sprocket wheel 56 mounted for rotation around the axis "c" of the lower of a pair of take-off rolls to be described hereinbelow. A hold-down roller sprocket wheel 58 is engaged by chain 46 so as to be driven in counterclockwise direction around the axis "d". Finally, the pitch chain 46 also drives a lower delivery roll sprocket wheel 60 mounted for movement around an axis "e". An idler sprocket wheel 62 completes the path of the chain back to sprocket wheel 48.

The drive system for the copy paper supply assembly includes a gear 64 adapted to be driven by the drum gear 18. A sprocket wheel 66 on a shaft common to the gear 64 is driven around an axis "f" to drive a pitch chain 68 in the direction of the arrow adjacent to the chain in FIG. 1. Chain 68 drives respective upper and lower paper supply roll sprocket wheels 70 and 72 mounted for movement around respective axes "g" and "h". A tensioning sprocket wheel 74 is arranged to give sufficient tension to the chain 68. All of the gear, sprocket wheel and pitch chain mechanism just described is located at the rear of the machine 10.

As can be seen by reference to FIG. 2, a spongy cleaner roll 76 mounted for movement around the axis "a" is driven by gear 52 so that the surface of the cleaning roll in engagement with the drum moves in a direction opposite to the direction of movement of the drum surface.

A take-off roll 78, more fully to be described hereinafter, cooperates with a roller 80 to deliver a picked off sheet to the nip between a pair of intermediate conveyor rolls 82 and 84, the roll 84 of which is mounted for movement around the axis "c". After leaving the rolls 82 and 84, the sheet passes between a hold-down roller 86 mounted for movement around the axis "d" so as to be brought into operative relationship with a dryer 88. As the sheet leaves the dryer 88, it enters the nip between delivery rolls 90 and 92, the lower roll 92 of which is mounted for movement around the axis "e". These rolls pass the copy to a tray 106, or the like.

The machine with which my pickoff is used includes two cassettes holding respective supplies 98 and 102 of paper of different sizes. Respective paper feeding rolls 100 and 104 associated with the supplies 98 and 102 are mounted for movement at the axes "g" and "h". Means (not shown) under the control of the operator is adapted to be actuated selectively to bring one or the other of the supplies 98 or 102 into cooperative relationship with its associated roller 100 or 104. The operative roller delivers a sheet to the nip between a pair of feed rolls 94 and 96, the upper one of which is mounted for movement at the axis "f". Rolls 94 and 96 deliver the fed sheet to the surface of the drum 16. The structure thus far described is that of a machine to which my pickoff device is applied.

Referring now to FIGS. 3 to 6, gear 42, which is disposed in a housing 108 carried by a side of the machine, drives a shaft 110 extending out of the housing 108. My pickoff clutch assembly indicated generally by the reference character 112 includes a driver member or element 114, which is keyed to the shaft 110 by a key 116. This key 116 is so arranged as to permit some radial movement of the clutch member 114 with reference to the shaft 110 for accurate positioning relative to the shaft in a manner to be described hereinbelow. Member 114 further is adapted to receive a reduced end portion 118 of turn roller 70, the arrangement being such that when the reduced end portion 118 is inserted into the member 114 roll 78 rotates with the member 114.

Housing 108 carries respective outwardly extending studs 120 and 122 which receive a bracket 124 secured to the studs by any suitable means known to the art. A pin 126 carried by the bracket 124 intermediate its ends pivotally supports an arm 128, the end of which carries a shaft 129 which rotatably supports a metal roller 130 having a knurled outer surface. A spring 134 wrapped around the pin 126 bears with one end against the bracket 124 and with the other end against the arm 128, so as to resiliently to urge the roller 130 into engagement with rubber rings 132 carried by clutch member 114.

The other clutch member or element 136 includes a disk-like portion on an integral axially extending hub portion 138 carried by a bushing 140 supported on the shaft 110. Respective ball bearings 142 and 144, the inner rings of which are received on the hub 138 are held in spaced relationship by a spacer 146 located between the outer rings of the bearings. These bearings 142 and 144 are received in a recess 148 formed in the clutch member 114. Bearings 142 and 144 accurately space clutch member 114 in a radial direction with reference to the hub 138 of the clutch member 136. As has been pointed out hereinabove, the key 116 permits some radial movement of the clutch member 114 relative to the shaft 110, thus to permit the bearings 142 and 144 to perform the function of accurately positioning the member 114 radially with reference to the hub 138 of the member 136.

From the structure thus far described, it will readily be apparent that shaft 110 continuously drives the member 114 owing to the connection therebetween provided by the key 116. Moreover, under the action of friction, member 136 likewise would tend to rotate with the shaft 110. I provide my clutch assembly with means for normally restraining member 136 against rotation with the shaft 110. I form clutch 136 with a cam 150 having a low point **150*a* followed by a rising portion 150*b* in the counterclockwise direction as viewed in FIG. 6 and then a relatively sharp drop 150*c*. Stud 120 rotatably supports a follower arm 154 carrying a follower 152 adapted to ride against the cam 150. A spring 156 on the stud 120 normally urges the arm 154 to rotate in a clockwise direction as viewed in the drawings. In the inactive condition of the parts, follower 152 rests against the low 150*a* of the cam. In this condition the action of spring 156 on the arm 154 overcomes the frictional tendency of the clutch member 136 to rotate with clutch member 114, so that the clutch member 136** is stationary.

I form the disk-like portion of clutch member 136 with a peripheral axially extending finger 158 which extends for a predetermined distance around the disk-like portion of member 136. It will be seen that finger 158 forms a narrow radial gap with member 114. The radial extent of the gap is accurately determined by the bearings 142 and 144. In practice the spacing between the finger 158 and the member 114 may be of the order of two mils. I provide a roughened surface portion 160 on the outer surface of member 114 below the finger 115 and highly polish the inner surface 162 of the member 158. As will more fully be explained hereinbelow, in operation of my clutch the surface 162 cooperates with the image bearing side of the copy sheet, while the surface 160 cooperates with the reverse side of the copy sheet. The space between the finger 158 and the member 114 is such that introduction of the leading edge of a sheet of common copy paper into the space between the finger and the member will clutch the finger and the member together with sufficient force to overcome the influence of spring 156 to cause the two members to move together. Moreover, as the two members move together, follower 152 rides up the rise **150*b*, thus to increase the force with which the leading edge of the paper is gripped. As the paper is thus carried around with the two clutch elements in a clockwise direction as viewed in the drawings, ultimately the sharp drop 150*c* in the surface of cam 150 will arrive at the location of the follower 152. Moreover, as the follower 152 moved up the rise 150, the force stored in the spring 156 increases. Thus, when the drop 150*c* arrives at the follower 152, the spring 156 rapidly moves clutch member 136 and finger 158 carried thereby in a clockwise direction but more rapidly than the speed of rotation of member 114, thus to release the portion of the leading edge of the copy which has been gripped by the clutch mechanism. It will readily be appreciated that the highly polished inner surface of finger 158 facilitates this releasing operation. Moreover, at the time of this releasing operation, the leading edge of the paper has already moved into the nip between the knurled roller 130 and the rubber rings 132. From this point, the copy paper is carried out of the machine by means of the delivery rolls 82 and 84. It is to be emphasized that under the action of the cam and follower, finger 158** is brought precisely back to the same location on each operation of the machine.

I may employ any suitable means for directing the leading edge of the sheet to be picked off into the space between the fingers 158 and member 114. For example, in the form of my apparatus illustrated in FIGS. 3 to 6, a thin finger 164 supported on a pivot 166 extending outwardly from housing 108 may be employed. This finger which preferably is formed from a low friction material, such for example as polytetrafluoroethylene has an edge which rests on the surface of drum 16, so as to intercept the leading edge of a sheet 168 of copy material and direct it into the space between finger 158 and clutch member 114.

Figure 7:
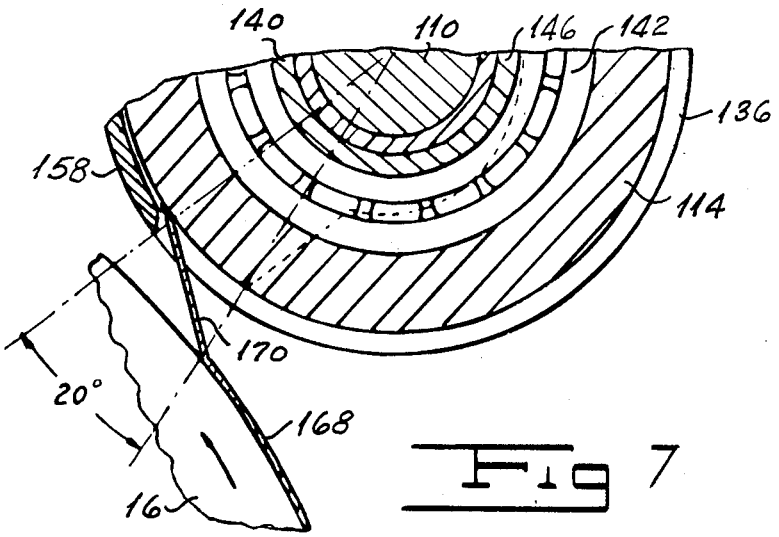
FIG. 7 is a view similar to FIG. 6 illustrating an alternate form of my pickoff device for copying machines.

Referring now to FIG. 7, in an alternate system any suitable means (not shown) might be employed to crimp the leading of the sheet to provide a raised portion 170 which is sufficiently spaced from the surface of drum 16 automatically to enter into the space between the finger 158 and the member 114. Such paper crimping devices are known in the art, such for example as that illustrated in U.S. Pat. No. 3,687,539, issued to Furuichi, for "Electrophotographic Apparatus".

Figure 8:
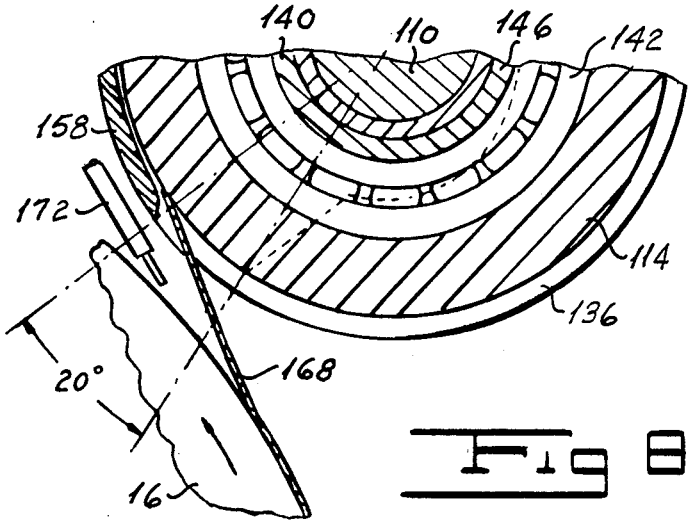
FIG. 8 is a view similar to FIG. 6 illustrating a further form of my pickoff device for copying machines.
Figure 9:
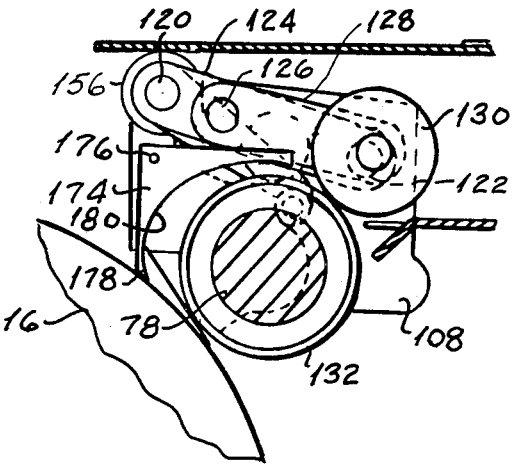
FIG. 9 is a fragmentary side elevation illustrating my means for returning a double fed copy sheet to the user of the machine.

Referring now to FIG. 8, in still another form of the pickoff device, an air jet 172 may be employed to lift the leading edge or corner of the sheet 158 a sufficient distance from the surface of the drum 16 to cause it to enter into the space between finger 158 and the member 114.

It will readily be appreciated that once the clutch mechanism has picked up the leading edge of a copy to be removed from the machine, it is not again in position to receive a second sheet until the copy has been delivered to the nip between the roller 130 and rings 132. It may happen in operation of any electrostatic copying machine of the image transfer type that in one cycle of the machine two sheets or lengths of copy material are fed from the supply toward the drum. Thus the danger exists that, while the first of the sheets may properly be picked off by the pickoff mechanism and received in the clutch, the second sheet will not be engaged by the clutch and may travel with the drum to the cleaning station at which it may become wrapped around the cleaning roll 76 with the attendant dangers pointed out hereinabove. I provide the machine 10 with means for obviating this possibility. More specifically, a shaft 176 supported on the housing of the machine 10 in any suitable manner pivotally carries one or more deflector members 174 at a location or locations spaced somewhat inboard of the clutch assembly 112. Each of the members 174 has a shoe portion 178 which rests on the surface of the drum 16. Any sheet which is not grasped by the clutch device is picked up by the shoe 178 which directs the leading edge thereof onto a surface 180 which causes the leading edge of the sheet to turn backwardly until it enters the nip between roll 130 and the rings 132. Thus, the sheet is carried out of the machine along precisely the same path as is a copy sheet which is picked off in the usual manner.

The operation of my pickoff device will readily be understood from the description hereinabove. So long as the drum 16 is being driven, shaft 110 is driven to drive clutch member 114. At the same time, the action of spring 156 prevents rotation of clutch member 136 with the member 114. After an image has been formed on the drum 16 and developed, a sheet of copy material is fed to the drum beneath the transfer corona 38. As the sheet moves past the transfer corona, the developed image migrates from the surface of the drum to the surface of the sheet in contact with the drum. As a sheet which has received the image moves out of the transfer location, its leading edge is caused to move into the space between finger 158 and member 114. This may be as a result of the action of a pickoff finger 164 or as the result of a crimp or bend 170 formed in the leading edge of the paper, or under the action of an air jet 172 or any other suitable means. Owing to the relationship of the thickness of the sheet 168 to the space between finger 158 and member 114, as the leading edge of the sheet enters the space, the finger 158 and member 114 are clutched together to overcome the force of spring 156 and to cause the follower 152 to ride up the cam rise **150*b*. As this occurs, the spring is loaded to increase the force with which the leading edge of the paper is grasped between the finger 158 and the member 114. After a predetermined rotation of member 114 to a location at which the leading edge of the paper has moved into the nip between roller 130 and rings 132, the cam drop 150*c* has arrived at the location of follower 152. At this point the force of the loaded spring 156 moves the member 136 and finger 158 in the same direction and at a greater speed than the member 114 to release the leading edge of the sheet. As has been pointed out hereinabove, the highly polished surface 162 of finger 158** facilitates this releasing action.

In addition to the foregoing, if by any chance a double feed occurs, the second sheet will be intercepted by the foot 178 of member 174 and will be caused to move around to a point at which it is picked up by the nip between the roller 130 and rings 132 and delivered to the user of the machine in the same manner as is an ordinary copy.

It will be seen that I have accomplished the objects of my invention. I have provided a pickoff for a copying machine which overcomes the defects of pickoff systems of the prior art. My pickoff device permits substantially the entire area of the copy sheet to receive a transferred image. My pickoff device is reliable in operation. My pickoff arrangement incooperates means for preventing a double fed sheet from becoming wrapped around the cleaning roller of the machine. It returns a double fed sheet to the user along the same path as does the copy sheet to which the image has been transferred. My device successfully picks a copy sheet off the drum and delivers it to the customer without smudging any part of the formed image and without dirtying the copy.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a copying machine of the image transfer type in which an image developed on a surface is transferred to a sheet of copy material which moves with the surface through a transfer station to a pickoff station, pickoff apparatus including a first clutch element, means for driving said first clutch element, a second clutch element, means mounting said second clutch element for movement relative to said first clutch element with a narrow space between said elements, an opening leading into said narrow space, means positioning said clutch elements with said opening at a location adjacent to said surface, means for directing a portion of a copy sheet from said moving surface into the space between said elements, the relationship between the thickness of said sheet and the space between said elements being such that entry of said sheet into said space clutches said elements to each other for movement as a unit, and means responsive to a predetermined movement of said elements as a unit for releasing said portion of a copy sheet.

2. Apparatus as in claim 1 including means normally restraining said elements against rotation as a unit normally to position said opening of said space at a predetermined location with reference to said surface, the clutching action of a sheet portion entering said space overcoming said restraining means.

3. Apparatus as in claim 1 in which said releasing means comprises means for driving said second clutch element in the same direction as and faster than said first clutch element.

4. Apparatus as in claim 1 including means for conveying a released sheet away from said machine.

5. Apparatus as in claim 1 including means normally restraining said second clutch element against movement with said first clutch element normally to position said opening of said space at a predetermined location with reference to said surface, the clutching action of a sheet portion entering said space overcoming said restraining means, said releasing means comprising means for driving said second clutch element in the same direction as and faster than said first clutch element.

6. Apparatus as in claim 5 including means for carrying a released copy sheet away from said machine.

7. Apparatus as in claim 6 in which said restraining means and said releasing means comprise a cam on said second clutch element, a follower, and a spring urging said follower into engagement with said cam, a first surface portion of said cam and said follower and said spring cooperating to restrain said second clutch element against movement with said first clutch element in the absence of a copy sheet portion in said space, a second surface portion of said cam acting on said follower to cock said spring during said predetermined rotation of said elements as a unit and a third surface portion of said cam cooperating with said follower to permit said cocked spring to drive said second clutch element in the same direction as and faster than said first element to release a copy sheet.

8. Apparatus as in claim 7 in which the surface of said first clutch element engaging said sheet portion is roughened and in which the surface of said second clutch element engaging said sheet portion is polished.

9. Apparatus as in claim 1 in which said first clutch element is cylindrical, and in which said second clutch element comprises an arcuate finger radially spaced from the surface of said first clutch element.

10. Apparatus as in claim 9 in which said driving means is a shaft, means keying said first clutch element to said shaft for rotation therewith and for limited radial movement, said means mounting said second clutch element comprising means supporting said element for rotary movement on said shaft and rolling bearing means between said first and second elements accurately to position said arcuate finger relative to the surface of said first clutch element.

11. Apparatus as in claim 1 in which said means for directing said sheet into said opening comprises a finger resting on said surface on which said image is developed.

12. Apparatus as in claim 1 in which said means for directing said sheet into said opening comprises means for directing a jet of air under a leading portion of a copy sheet on said surface on which said image is developed.

13. Apparatus as in claim 1 in which said means for directing said sheet into said opening comprises a crimp adjacent to the leading edge of said copy sheet.

14. Apparatus as in claim 1 including means for intercepting a copy sheet directed from said surface which misses said opening.

15. Apparatus as in claim 1 including roller means forming a nip for receiving a released copy sheet and for carrying said released sheet away from said machine and means for intercepting a copy sheet which misses said opening and for directing said intercepted sheet into said nip.

16. Apparatus as in claim 1 in which said means responsive to a predetermined movement of said elements as a unit comprises means for moving said elements relative to each other to release said portion of a copy sheet.

17. In a copying machine of the image transfer type in which an image developed on a surface is transferred to a sheet of copy material which moves through a transfer station to a pickoff station, pickoff apparatus at said pickoff station including a first cylindrical clutch element, means including a shaft for driving said first clutch element, a second clutch element comprising an arcuate finger, means mounting said second clutch element for rotary movement with reference to said first clutch element with a radially narrow accurately defined circumferential space between said finger and the surface of said first clutch element, said space having an opening in a circumferential direction, a cam on said second clutch element, a follower, means comprising a spring urging said follower into engagement with said cam, a first surface portion of said cam and said follower and said spring cooperating normally to position said opening at a predetermined location with reference to said surface, and means for directing a leading portion of a copy sheet from said surface into said opening at said location, the relationship between the thickness of a copy sheet and radial extent of said space being such that a portion of a sheet entering said space clutches said elements to each other for movement as a unit, a second surface portion of said cam and said follower cocking said spring as said elements move together over a predetermined distance, a third surface portion of said cam and said cocked spring and said follower driving said second clutch element in the same direction as and faster than said first clutch element after said elements move together over said predetermined distance to release said copy sheet portion.

18. Apparatus as in claim 17 including roller means forming a nip at a location spaced around said first clutch element by approximately said predetermined distance for receiving a released copy sheet and for carrying said copy sheet away from said machine.

19. Apparatus as in claim 18 in which said roller means comprises a first roller carried by said first clutch element for rotation therewith, a second roller and means biasing said second roller into engagement with said first roller.

20. Apparatus as in claim 17 in which said driving means comprises a key coupling said first member to said shaft for rotary movement therewith and for radial movement relative thereto and in which said means mounting said second clutch element comprises means mounting said second element for rotary movement on said shaft and rolling bearing means between said first and second clutch elements.

21. Apparatus as in claim 11 in which a surface portion of said first clutch element engages a copy sheet entering said space, said surface portion of said first clutch element which engages said copy sheet is roughened and in which the surface portion of said second clutch element which engages said copy sheet is polished.

22. Apparatus as in claim 17 including auxiliary means for intercepting a copy sheet directed from said surface which misses said opening location.

23. Apparatus as in claim 17 including roller means forming a nip at a location spaced around said clutch element by approximately said predetermined distance for receiving a released copy sheet and for carrying said copy sheet away from said machine and auxiliary means for intercepting a copy sheet directed from said surface which misses said opening and for guiding said intercepted copy sheet into said nip.

* * * * *